US012339066B2

(12) United States Patent
Bhatia et al.

(10) Patent No.: US 12,339,066 B2
(45) Date of Patent: Jun. 24, 2025

(54) MICROCHANNEL HEAT EXCHANGER WITH VARYING FIN DENSITY

(71) Applicant: Johnson Controls Technology Company, Auburn Hills, MI (US)

(72) Inventors: Rupesh Bhatia, Cockeysville, MD (US); Stephen Maurice Zardus, York, PA (US); Matthew Christopher Ferrero, Shrewsbury, PA (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 568 days.

(21) Appl. No.: 17/311,256

(22) PCT Filed: Dec. 4, 2019

(86) PCT No.: PCT/US2019/064499
§ 371 (c)(1),
(2) Date: Jun. 4, 2021

(87) PCT Pub. No.: WO2020/117953
PCT Pub. Date: Jun. 11, 2020

(65) Prior Publication Data

US 2022/0026154 A1 Jan. 27, 2022

Related U.S. Application Data

(60) Provisional application No. 62/776,303, filed on Dec. 6, 2018.

(51) Int. Cl.
*F28F 1/12* (2006.01)
*F28D 1/053* (2006.01)

(52) U.S. Cl.
CPC ..... *F28D 1/05391* (2013.01); *F28F 1/126* (2013.01); *F28F 2215/04* (2013.01); *F28F 2260/02* (2013.01)

(58) Field of Classification Search
CPC ..... F28D 1/0539; F28F 1/126; F28F 2215/04; F28F 2260/02
See application file for complete search history.

(56) References Cited

U.S. PATENT DOCUMENTS 4,201,263 A * 5/1980 Anderson ..... F25B 39/022 165/146
4,330,034 A * 5/1982 Lang ..... F22B 37/74 165/113

(Continued)

FOREIGN PATENT DOCUMENTS

CN 101963418 A 2/2011
CN 104214830 A 12/2014

(Continued)

OTHER PUBLICATIONS

Translation of JPS59161687A entitled Translation—JPS59161687A (Year: 2023).*

(Continued)

*Primary Examiner* — Paul Alvare
(74) *Attorney, Agent, or Firm* — Fletcher Yoder, P.C.

(57) ABSTRACT

A heat exchanger of a heating, ventilation, air conditioning, and refrigeration (HVAC&R) system includes a plurality of microchannel tubes, where each microchannel tube of the plurality of microchannel tubes is configured to direct refrigerant therethrough, and a plurality of fin sets, where each fin set of the plurality of fin sets is disposed between corresponding adjacent microchannel tubes of the plurality of microchannel tubes. Additionally, each fin set of the plurality of fin sets includes a respective fin density based on a location of the respective fin set along a height of the heat exchanger.

20 Claims, 6 Drawing Sheets

(56) References Cited

U.S. PATENT DOCUMENTS

| | | | | | |
|---|---|---|---|---|---|
| RE35,742 | E * | 3/1998 | Hoshino | F28F 1/128 | 165/110 |
| 6,354,367 | B1 * | 3/2002 | Gong | F28F 1/32 | 165/125 |
| 9,115,934 | B2 * | 8/2015 | Kopchick | F28F 9/0212 | |
| 2003/0159814 | A1 * | 8/2003 | Sin | F28F 13/04 | 165/150 |
| 2007/0131393 | A1 * | 6/2007 | Sasaki | F28F 1/022 | 165/110 |
| 2008/0142203 | A1 * | 6/2008 | Yanik | F25B 39/00 | 165/151 |
| 2009/0173477 | A1 * | 7/2009 | Raver | F28F 1/128 | 165/151 |
| 2009/0288440 | A1 * | 11/2009 | Yanik | F28D 1/0417 | 165/173 |
| 2011/0017438 | A1 * | 1/2011 | Huazhao | F28D 1/05316 | 165/173 |
| 2011/0220318 | A1 * | 9/2011 | Kopchick | F28F 9/0212 | 165/41 |
| 2013/0213073 | A1 * | 8/2013 | Fritz | F25D 17/067 | 165/173 |
| 2013/0213624 | A1 * | 8/2013 | Fujii | F28F 1/126 | 165/172 |
| 2017/0336114 | A1 * | 11/2017 | Lee | F25D 21/08 | |

FOREIGN PATENT DOCUMENTS

| | | | | | |
|---|---|---|---|---|---|
| CN | 104981674 | A | | 10/2015 | |
| DE | 202011003939 | U1 | * | 6/2011 | F28D 1/024 |
| JP | S59161687 | A | * | 9/1984 | |
| JP | H1123184 | A | * | 1/1999 | |
| JP | 2000193389 | A | * | 7/2000 | |
| JP | 2001174168 | A | * | 6/2001 | F28D 1/0391 |
| JP | 2005049043 | A | * | 2/2005 | |
| JP | 2008126820 | A | * | 6/2008 | |
| WO | WO-0192804 | A1 | * | 12/2001 | F28D 1/0417 |
| WO | 2008136916 | A1 | | 11/2008 | |
| WO | WO-2011005986 | A2 | * | 1/2011 | F24F 1/18 |

OTHER PUBLICATIONS

Translation of JPH1123184A entitled Translation—JPH1123184A (Year: 2023).*

Translation of JP2005049043A entitled Translation—JP2005049043A (Year: 2023).*

European Office Action for EP Application No. 19828098.4, mailed Mar. 13, 2023, 5 pages.

International Search Report and Written Opinion for PCT Application No. PCT/US2019/064499, mailed Mar. 5, 2020, 13 pgs.

Chinese Office Action for CN Application No. 201980079242.5, mailed Jun. 13, 2022, 12 pages.

* cited by examiner

MICROCHANNEL HEAT EXCHANGER WITH VARYING FIN DENSITY

CROSS REFERENCE TO RELATED APPLICATION

This application claims the benefit of and priority from U.S. Provisional Patent Application Ser. No. 62/776,303, entitled "Microchannel Heat Exchanger with Varying Fin Density," filed Dec. 6, 2018, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Chiller systems, or vapor compression systems, utilize a working fluid, typically referred to as a refrigerant, which changes phases between vapor, liquid, and combinations thereof in response to exposure to different temperatures and pressures associated with operation of the vapor compression system. For example, an HVAC&R system may include a chiller, which is a type of vapor compression system, which circulates a refrigerant to remove heat from a flow of working fluid in a heat exchange relationship with the refrigerant in a chiller evaporator.

A vapor compression system may include a heat exchanger configured to transfer heat between the working fluid and a conditioned fluid. For example, the heat exchanger may be configured to cool the conditioned fluid by placing the conditioned fluid in thermal communication with the working fluid and enabling the working fluid to absorb heat from the conditioned fluid. The heat exchanger may also be configured to cool the working fluid by placing the working fluid in thermal communication with a cooling fluid, such as ambient air, where the cooling fluid absorbs heat from the working fluid. In some embodiments, the heat exchanger may be a microchannel heat exchanger that includes several microchannel tubes positioned adjacent to one another. A set of fins may be disposed between adjacent microchannel tubes to facilitate heat transfer between the working fluid and another fluid. In certain traditional microchannel heat exchangers, the orientation of each set of fins is the same between each set of adjacent microchannel tubes, which may cause an undesirable amount of heat transfer across a profile of the heat exchanger.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heat exchanger of a heating, ventilation, air conditioning, and refrigeration (HVAC&R) system includes a plurality of microchannel tubes, where each microchannel tube of the plurality of microchannel tubes is configured to direct refrigerant therethrough, and a plurality of fin sets, where each fin set of the plurality of fin sets is disposed between corresponding adjacent microchannel tubes of the plurality of microchannel tubes. Additionally, each fin set of the plurality of fin sets includes a respective fin density based on a location of the respective fin set along a height of the heat exchanger.

In another embodiment, a heat exchanger of a heating, ventilation, air conditioning, and refrigeration (HVAC&R) system includes a plurality of microchannel coils arranged along a height of the heat exchanger, where each microchannel coil of the plurality of microchannel coils extends along a length of the heat exchanger, and a plurality of fin sets, where each fin set of the plurality of fin sets is disposed between a corresponding pair of adjacent microchannel coils of the plurality of microchannel coils, wherein each fin set of the plurality of fin sets extends along the length of the heat exchanger. Additionally each fin set of the plurality of fin sets includes a fin density that is selected based at least in part on a respective location of the fin set along the height of the heat exchanger.

In another embodiment, a heat exchanger includes a first section and a second section. The first section includes a plurality of first microchannel tubes and a plurality of first fin sets disposed between corresponding adjacent first microchannel tubes of the plurality of first microchannel tubes, where each first fin set of the plurality of first fin sets includes a first number of fins. The second section includes a plurality of second microchannel tubes and a plurality of second fin sets disposed between corresponding adjacent second microchannel tubes of the plurality of second microchannel tubes, where each second fin set of the plurality of second fin sets includes a second number of fins, where the second number of fins is less than the first number of fins.

DRAWINGS

Various aspects of this disclosure may be better understood upon reading the following detailed description and upon reference to the drawings in which.

DETAILED DESCRIPTION

Figure 1:
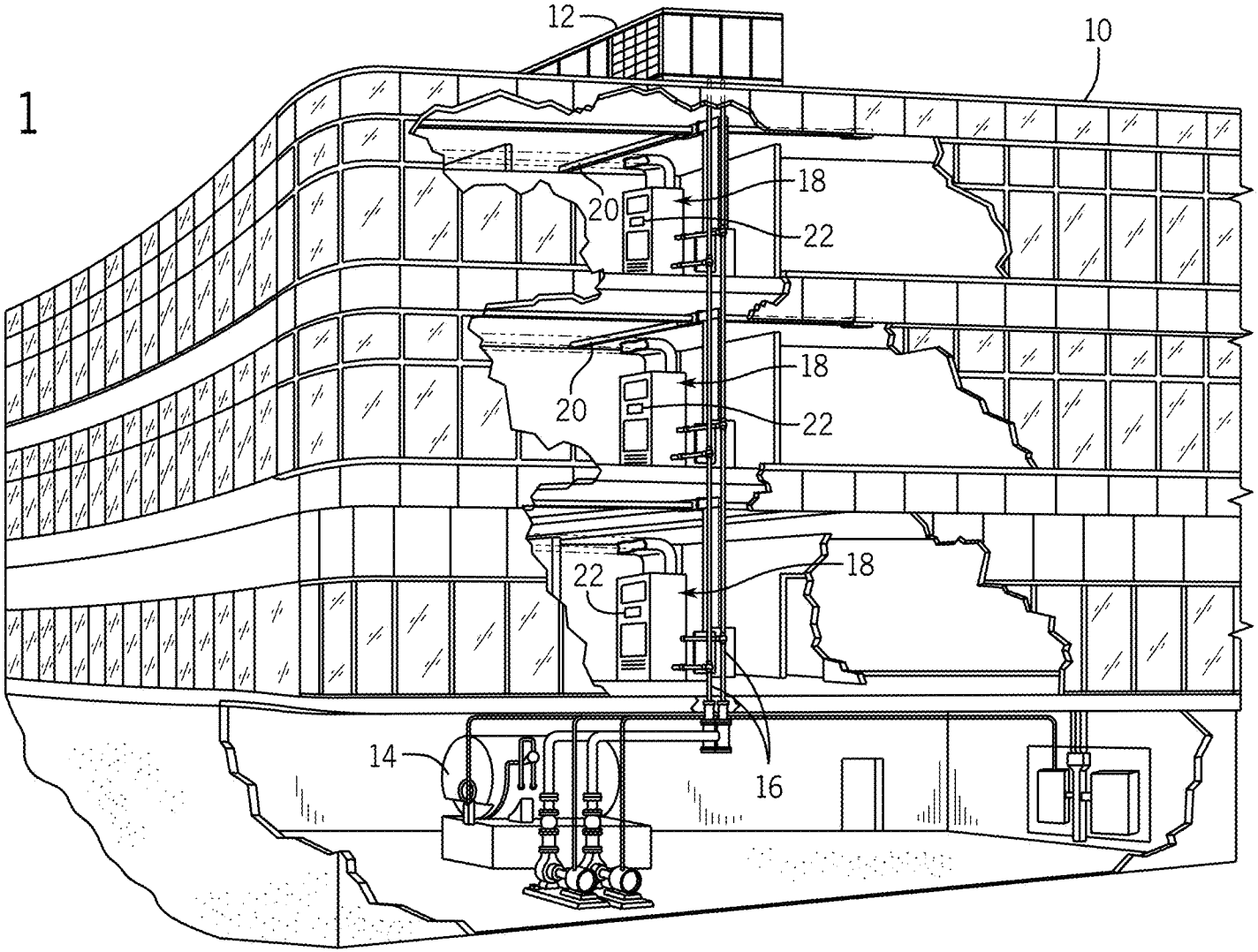
FIG. 1 is a perspective view of a building that may utilize an embodiment of a heating, ventilation, and air conditioning (HVAC) system in a commercial setting, in accordance with an aspect of the present disclosure.

Embodiments of the present disclosure include a microchannel heat exchanger with varying fin densities at different sections of the microchannel heat exchanger, which may produce an improved velocity profile of fluid directed across the microchannel heat exchanger. For example, varying the fin density of the microchannel heat exchanger may enable a velocity of the fluid to vary throughout the microchannel heat exchanger and achieve target velocities at various positions of the microchannel heat exchanger. In general, as the refrigerant flows through the microchannel tubes, heat is transferred between the refrigerant and the microchannel tubes. Further, as the fluid is directed across the microchannel tubes, heat is transferred between the fluid and the microchannel tubes. As previously mentioned, a set of fins may be disposed between adjacent microchannel tubes to increase an amount of heat to transfer between the refrigerant and the fluid. Specifically, in addition to transferring heat between the refrigerant and the microchannel tubes, heat may be transferred between the refrigerant and the fins across and/or along a length of each microchannel tube. As the fluid is directed across the microchannel tubes, the fluid is placed in contact with the microchannel tubes and with the fins to absorb or transfer heat from the refrigerant with both the microchannel tubes and the fins. In this manner, the fins increase the surface area that the fluid contacts, to exchange heat with the refrigerant.

As should be understood, an improved or desired velocity profile of fluid directed across the microchannel heat exchanger may increase efficiency of heat transfer between refrigerant flowing within the microchannel tubes and a fluid (e.g., air) directed across the microchannel tubes. In general, the velocity of the fluid directed across the microchannel tubes may determine an amount of heat transferred between the refrigerant and the fluid. For example, directing the fluid at a higher velocity may increase the amount of heat transferred between the refrigerant and the fluid. Based on a design of the heat exchanger, it may be desirable to direct the fluid across the heat exchanger at particular velocities in certain areas or sections of the heat exchanger. For instance, the heat exchanger includes a first section where the refrigerant is initially supplied and has a greater capacity to exchange heat with the fluid. Furthermore, the heat exchanger includes a second section near an exit of the refrigerant where the refrigerant has a lower capacity to exchange heat with the fluid. Thus, it may be desirable to direct the fluid across the heat exchanger at a higher velocity at the first section as compared to the second section to enable a greater amount of thermal energy transfer between the fluid and the refrigerant. As an example, the improved velocity profile may be a substantially evenly distributed profile, a velocity profile that is a gradient relative to a length of the heat exchanger, a velocity profile that is symmetric relative to an axis of the heat exchanger, and/or any other suitable velocity profiles.

In some microchannel heat exchangers, the orientation of fins may be similar throughout the heat exchanger. Specifically, an angle of each fin with respect to the microchannel tube, a number of fins, a spacing of fins, a length of each fin, and/or other properties of the fins may be similar or the same throughout the heat exchanger. However, a uniform orientation of fins throughout the heat exchanger may cause an undesirable distribution of fluid passing across certain sections of the heat exchanger due to a position of a fan forcing the fluid across the heat exchanger with respect to the microchannel tubes and/or the fins. As a result, an efficiency of the heat exchanger and/or an amount of fluid directed across the heat exchanger may be reduced.

Accordingly, it is now recognized that varying the orientation of fins in different sections of the heat exchanger may increase a performance of the heat exchanger. For example, adjusting the number of fins in certain sections of the heat exchanger may produce an improved distribution of fluid flow throughout the heat exchanger. Enhancing the distribution of fluid flow may enable a greater amount of heat to transfer between the fluid and the refrigerant to increase the efficiency of the heat exchanger.

Turning now to the drawings, FIG. 1 is a perspective view of an embodiment of a heating, ventilation, and air conditioning (HVAC) system for a building 10 in a typical commercial setting. Such systems, in general, may be applied in a range of settings, both within the HVAC field and outside of the HVAC field. The HVAC systems may provide cooling to conditioned spaces of buildings, data centers, electrical devices, freezers, coolers, or other environments through vapor-compression refrigeration, absorption refrigeration, or thermoelectric cooling. In presently contemplated applications, HVAC systems may be used in residential, commercial, light industrial, industrial, and in any other application for heating or cooling a volume or enclosure, such as a residence, building, structure, and so forth. Moreover, the HVAC systems may be used in industrial applications, where appropriate, for cooling and heating of various fluids.

The HVAC system may include a chiller 12 that supplies a chilled liquid, which may be used to cool the building 10. The HVAC system may also include a boiler 14 to supply warm liquid to heat the building 10 and an air distribution system that circulates air through the building 10. As shown, the chiller 12 is disposed on the roof of the building 10, and the boiler 14 is located in the basement; however, the chiller 12 and boiler 14 may be located in other equipment rooms or areas in or next to the building 10. The chiller 12 may be an air cooled or water cooled device that implements a refrigeration cycle to cool water or other conditioning fluid. The chiller 12 is housed within a structure that includes a refrigeration circuit, a free cooling system, and associated equipment such as pumps, valves, and piping. For example, the chiller 12 may be single package rooftop unit that incorporates a free cooling system. The boiler 14 is a closed vessel in which water is heated. The water from the chiller 12 and the boiler 14 is circulated through the building 10 by water conduits 16. The water conduits 16 are routed to air handlers 18 located on individual floors and within sections of the building 10.

The air handlers 18 are coupled to ductwork 20 that is adapted to distribute air between the air handlers 18 and may receive air from an outside intake (not shown). In some embodiments, the air handlers 18 may include a heat exchanger that is connected to the boiler 14 and the chiller 12. The heat exchanger in the air handler 18 may receive either heated liquid from the boiler 14 or chilled liquid from the chiller 12, depending on the mode of operation of the HVAC system, to provide heated or cooled air to conditioned spaces within the building 10. Fans within the air handlers 18 force air across the heat exchangers and direct the conditioned air to environments within building 10, such as rooms, apartments, or offices, to maintain the environments at a designated temperature. A control device 22, shown here as including a thermostat, may be used to designate the temperature of the conditioned air. The control device 22 also may be used to control the flow of air through and from the air handlers 18. Other devices may be included in the system, such as control valves that regulate the flow of water and pressure and/or temperature transducers or switches that sense the temperatures and pressures of the water, the air, and so forth. Moreover, control devices may include computer systems that are integrated with or separate from other building control or monitoring systems, and even systems that are remote from the building 10. The HVAC system is shown with a separate air handler on each floor of building 10, but in other embodiments, the HVAC system may include air handlers 18 and/or other components that may be shared between or among floors.

Figure 2:
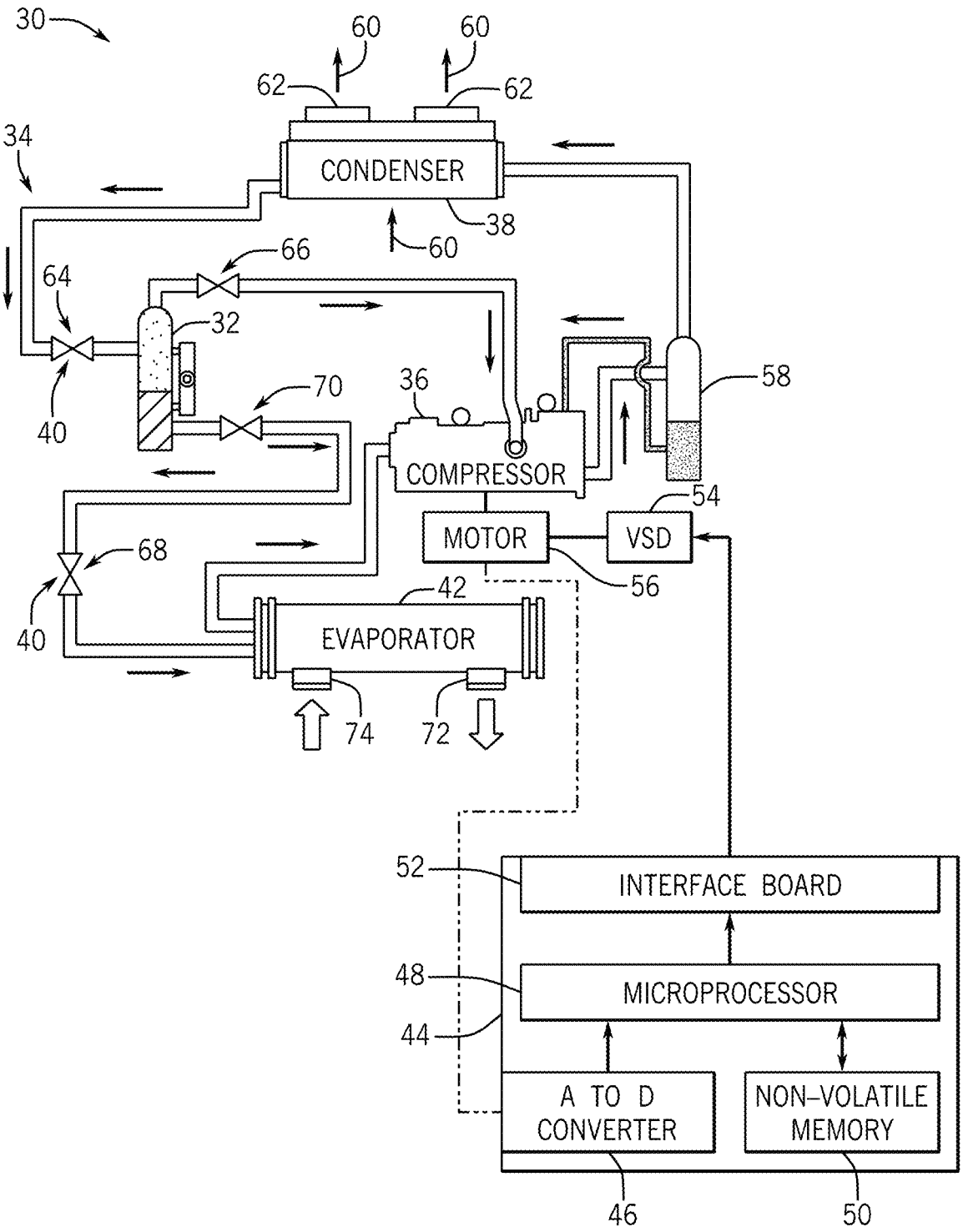
FIG. 2 is a schematic of an embodiment of an HVAC system, in accordance with an aspect of the present disclosure.

FIG. 2 is a schematic of an embodiment of an HVAC system 30, in accordance with the present techniques. For example, the HVAC system 30 may be an air-cooled chiller. However, it should be appreciated that the disclosed techniques may be incorporated with a variety of other systems, such as water-cooled chillers, direct expansion HVAC systems, and so forth.

The HVAC system 30 (e.g., vapor compression system) includes a refrigerant circuit 34 configured to circulate a working fluid, such as refrigerant, therethrough with a compressor 36 (e.g., a screw compressor) disposed along the refrigerant circuit 34. The refrigerant circuit 34 also includes a flash tank 32, a condenser 38, expansion valves or devices 40, and a liquid chiller or an evaporator 42. The components of the refrigerant circuit 34 enable heat transfer between the working fluid and other fluids (e.g., a conditioning fluid, air, water, etc.) in order to provide cooling to an environment, such as an interior of the building 10.

Some examples of fluids that may be used as refrigerants in the vapor compression system 14 are hydrofluorocarbon (HFC) based refrigerants, for example, R-410A, R-407, R-134a, hydrofluoro-olefin (HFO), "natural" refrigerants like ammonia (NH3), R-717, carbon dioxide (CO2), R-744, or hydrocarbon based refrigerants, water vapor, refrigerants with low global warming potential (GWP), or any other suitable refrigerant. In some embodiments, the vapor compression system 14 may be configured to efficiently utilize refrigerants having a normal boiling point of about 19 degrees Celsius (66 degrees Fahrenheit or less) at one atmosphere of pressure, also referred to as low pressure refrigerants, versus a medium pressure refrigerant, such as R-134a. As used herein, "normal boiling point" may refer to a boiling point temperature measured at one atmosphere of pressure.

The HVAC system 30 may further include a control panel 44 (e.g., controller) that has an analog to digital (A/D) converter 46, a microprocessor 48, a non-volatile memory 50, and/or an interface board 52. In some embodiments, the HVAC system 30 may use one or more of a variable speed drive (VSDs) 54 and a motor 56. The motor 56 may drive the compressor 36 and may be powered by the VSD 54. The VSD 54 receives alternating current (AC) power having a particular fixed line voltage and fixed line frequency from an AC power source, and provides power having a variable voltage and frequency to the motor 56. In other embodiments, the motor 56 may be powered directly from an AC or direct current (DC) power source. The motor 56 may include any type of electric motor that can be powered by the VSD 54 or directly from an AC or DC power source, such as a switched reluctance motor, an induction motor, an electronically commutated permanent magnet motor, or another suitable motor.

The compressor 36 compresses a refrigerant vapor and delivers the vapor to an oil separator 58 that separates oil from the refrigerant vapor. The refrigerant vapor is then directed toward the condenser 38 through a discharge passage, and the oil is returned to the compressor 36. In some embodiments, the compressor 32 may be a centrifugal compressor. The refrigerant vapor delivered by the compressor 36 to the condenser 38 may transfer heat to a cooling fluid (e.g., water or air) in the condenser 38. For example, the cooling fluid may be ambient air 60 forced across heat exchanger coils of the condenser 38 by condenser fans 62. The refrigerant vapor may condense to a refrigerant liquid in the condenser 38 as a result of thermal heat transfer with the cooling fluid (e.g., the ambient air 60).

The refrigerant liquid exits the condenser 38 and may flow through a first expansion device 64 (e.g., expansion device 40, electronic expansion valve, etc.). The first expansion device 64 may be a flash tank feed valve configured to control flow of the liquid refrigerant to the flash tank 32. The first expansion device 64 is also configured to lower the pressure of (e.g., expand) the liquid refrigerant received from the condenser 38. During the expansion process, a portion of the liquid may vaporize, and thus, the flash tank 32 may be used to separate the vapor from the liquid received from the first expansion device 64. Additionally, the flash tank 32 may provide for further expansion of the liquid refrigerant because of a pressure drop experienced by the liquid refrigerant when entering the flash tank 32 (e.g., due to a rapid increase in volume experienced when entering the flash tank 32).

The vapor in the flash tank 32 may exit and flow to the compressor 36. For example, the vapor may be drawn to an intermediate stage or discharge stage of the compressor 36 (e.g., not the suction stage). A valve 66 (e.g., economizer valve, solenoid valve, etc.) may be included in the refrigerant circuit 34 to control flow of the vapor refrigerant from the flash tank 32 to the compressor 36. In some embodiments, when the valve 66 is open (e.g., fully open) additional liquid refrigerant within the flash tank 32 may vaporize and provide additional subcooling of the liquid refrigerant within the flash tank 32. The liquid refrigerant that collects in the flash tank 32 may be at a lower enthalpy than the liquid refrigerant exiting the condenser 38 because of the expansion in the first expansion device 64 and/or the flash tank 32. The liquid refrigerant may flow from the flash tank 32, through a second expansion device 68 (e.g., expansion device 40, an orifice, etc.), and to the evaporator 42. In some embodiments, the refrigerant circuit 34 may also include a valve 70 (e.g., drain valve) configured to regulate flow of liquid refrigerant from the flash tank 32 to the evaporator 42. For example, the valve 70 may be controlled (e.g., via the control board 44) based on an amount of suction superheat of the refrigerant.

The refrigerant liquid delivered to the evaporator 42 may absorb heat from another cooling fluid, which may or may not be the same cooling fluid used in the condenser 38. The refrigerant liquid in the evaporator 42 may undergo a phase change from the refrigerant liquid to a refrigerant vapor. As shown in the illustrated embodiment of FIG. 2, the evaporator 42 may include a tube bundle fluidly coupled to a supply line 72 and a return line 74 connected to a cooling load. The cooling fluid of the evaporator 42 (e.g., water, ethylene glycol, calcium chloride brine, sodium chloride brine, or any other suitable fluid) enters the evaporator 42 via return line 74 and exits the evaporator 38 via supply line 72. The evaporator 42 may reduce the temperature of the cooling fluid in the tube bundle via thermal heat transfer with the refrigerant so that the cooling fluid may be utilized to provide cooling for a conditioned environment. The tube bundle in the evaporator 42 can include a plurality of tubes and/or a plurality of tube bundles. In any case, the refrigerant vapor exits the evaporator 42 and returns to the compressor 36 by a suction line to complete the cycle.

Figure 3:
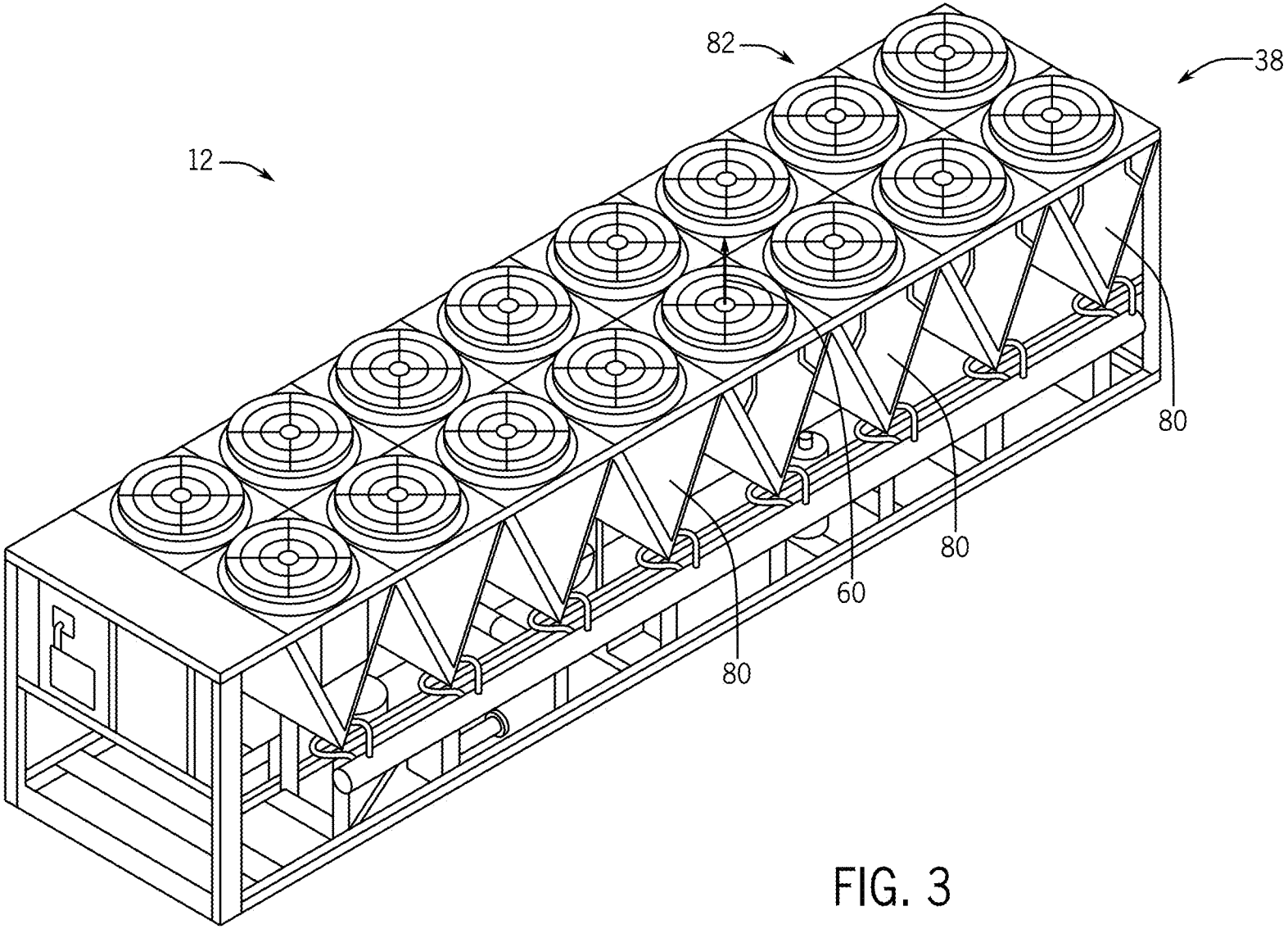
FIG. 3 is a perspective view of an embodiment of an HVAC system, in accordance with an aspect of the present disclosure.

FIG. 3 is a perspective view of an embodiment of the chiller 12 that may be utilized in the HVAC system 30 of FIG. 2. The chiller 12 may include both a mechanical cooling system (e.g., a vapor-compression refrigeration cycle) and a free cooling system to enhance an efficiency of the chiller 12. In certain embodiments, the mechanical cooling system of the chiller 12 may be an air-cooled variable-speed screw chiller and may use include the condenser 38, which may include multiple slabs 80 through which refrigerant directed. As an example, the mechanical cooling system may be a two-circuit, variable-speed screw chiller with variable speed condenser fans 82 (e.g., fans that may be used with one or more air-cooled heat exchangers) configured to direct the ambient air 60 across the slabs 80. Additionally, the chiller 12 may include a free-cooling system that may be utilized alone, or in combination with, the mechanical cooling system (e.g., a vapor-compression refrigeration cycle).

In certain embodiments, the chiller 12 may include a control system (e.g., the control board 44) configured to determine whether (and how) to operate the mechanical cooling system and/or the free cooling system based on a temperature of the ambient air 60 (e.g., air in a surrounding environment of the chiller 12) and/or a cooling load demand (e.g., an amount of cooling demanded by a load). Accordingly, the chiller 12 may operate the mechanical cooling system only (e.g., mechanical cooling mode), the free cooling system only (e.g., free cooling mode), or the mechanical cooling system and the free cooling system simultaneously (e.g., hybrid cooling mode) to meet the cooling load demand.

In some embodiments, the condenser 38 and/or the evaporator 42 may be a microchannel type heat exchanger. In microchannel heat exchangers, an improved distribution of fluid passing across the heat exchanger may be desired to increase an amount of heat transfer between the fluid and the refrigerant. Accordingly, fins of the microchannel heat exchangers may be oriented or arranged to produce an improved distribution of fluid relative to certain traditional microchannel heat exchangers.

Figure 4:
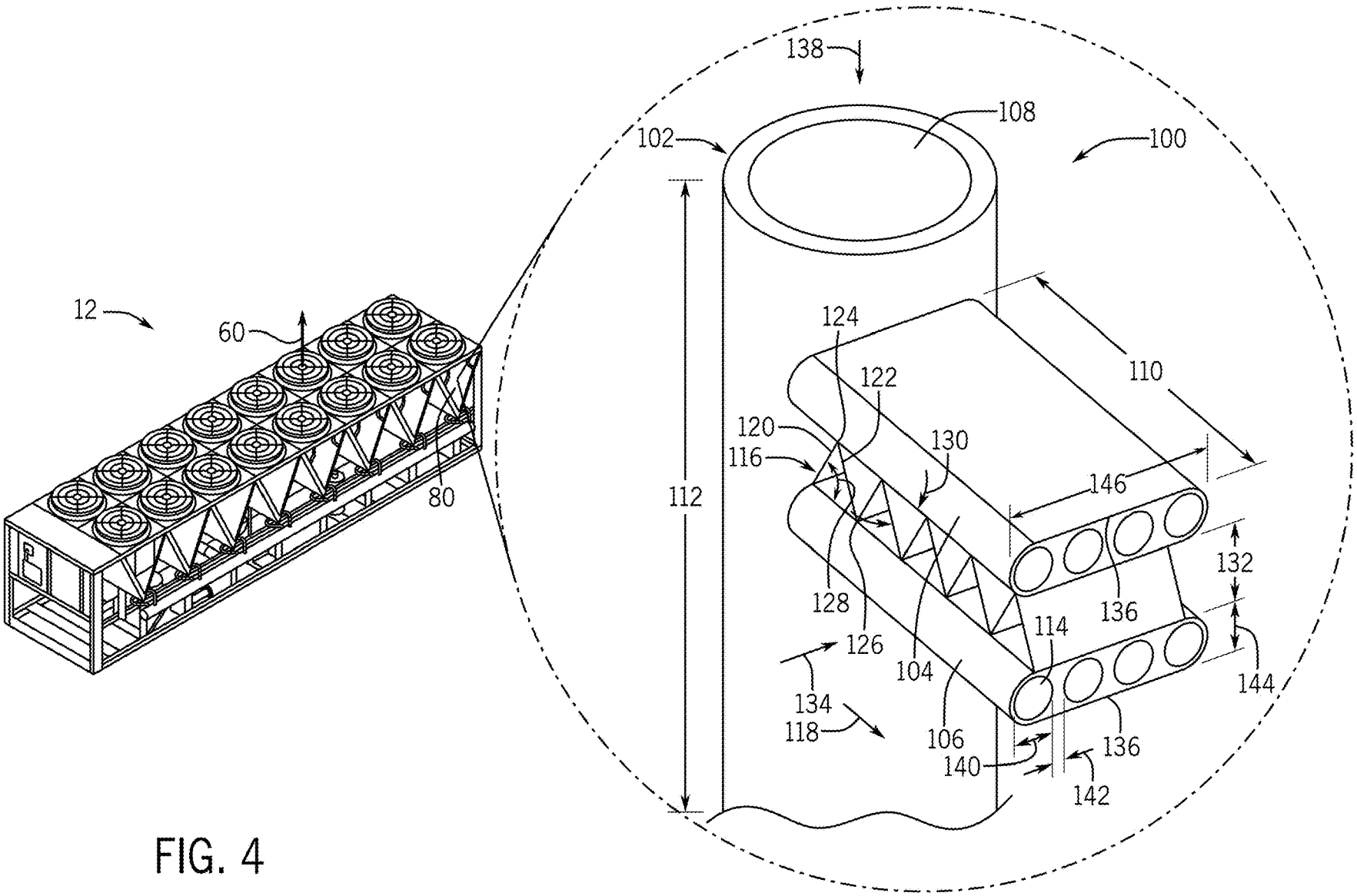
FIG. 4 is a partial perspective view of an embodiment of a microchannel heat exchanger, which may be utilized with any of the systems of FIGS. 1-3, in accordance with an aspect of the present disclosure.

FIG. 4 is a partial perspective view of a section of an embodiment of a microchannel heat exchanger 100, which is illustrated as being employed by one of the slabs 80 of the condenser 38. Accordingly, the ambient air 60 may be directed across the microchannel heat exchanger 100 to cool refrigerant flowing within the microchannel heat exchanger 100. Thus, the microchannel heat exchanger 100 may be utilized in an air-cooled chiller. However, in additional or alternative embodiments, the microchannel heat exchanger 100 may be utilized in any suitable chiller, such as a water-cooled chiller, a residential chiller, and so forth. In further embodiments, the microchannel heat exchanger 100 may be utilized in another type of heat exchanger, such as the evaporator 42.

The microchannel heat exchanger 100 includes a header 102 configured to direct the refrigerant to a first microchannel tube 104 and a second microchannel tube 106, adjacent to the first microchannel tube 104. As illustrated in FIG. 4, the header 102 is oriented to direct the refrigerant in a generally vertical direction through an opening 108 of the header 102. The first and second microchannel tubes 104, 106 may be fluidly coupled to the header 102 to direct the refrigerant through the first and second microchannel tubes 104, 106 at an angle relative to the flow through the header 102. For example, a length 110 of the first and second microchannel tubes 104, 106 may extend generally perpendicularly to a length or height 112 of the header 102, such that the flow of refrigerant through the first and second microchannel tubes 104, 106 is substantially perpendicular to the flow of refrigerant through the header 102. In other embodiments, the first and second microchannel tubes 104, 106 may be oriented at other suitable angles relative to the height 112 of the header 102. Each of the first and second microchannel tubes 104, 106 may include a set of ports 114 spanning the length 110 of the first and second microchannel tubes 104, 106, where the refrigerant is configured to flow through each port 114. Additionally, a set of fins 116 may be disposed between the first microchannel tube 104 and the second microchannel tube 106. In some embodiments, the set of fins 116 includes individual fins connected to both the first microchannel tube 104 and the second microchannel tube 106 and oriented in a zigzag formation. That is, moving in a direction 118 along the length 110 of the first and second microchannel tubes 104, 106, the set of fins 116 may alternate between first fins 120 and second fins 122. Specifically, each first fin 120 may extend from the second microchannel tube 106 at least partially in the direction 118 toward the first microchannel tube 104. Additionally, each second fin 122 may extend from the first microchannel tube 104 at least partially in the direction 118 toward the second microchannel tube 106.

In some embodiments, the first fins 120 may be separate from the second fins 122, and each first fin 120 may be in contact with or substantially proximate to an adjacent second fin 122. For example, each first fin 120 may contact the first microchannel tube 104 at a point 124 of the first microchannel tube 104, and each second fin 122 may extend from the point 124 toward the second microchannel tube 106 in the direction 118. Additionally, each second fin 122 may contact the second microchannel tube 106 at a point 126 of the second microchannel tube 106, and each first fin 120 may extend from the second microchannel tube 106 at the point 126 toward the first microchannel tube 104 in the direction 118. In additional or alternative embodiments, the first fins 120 may be connected to the second fins 122, such that the set of fins 116 is continuous along the length 110 and in contact with the first and second microchannel tubes 104, 106. In certain embodiments, each first fin 120 may form an angle 128 between each first fin 120 and the first microchannel tube 104 and/or second microchannel tube 106. Moreover, each second fin 122 may form an angle 130 between each second fin 122 and the first microchannel tube 104 and/or second microchannel tube 106. In some embodiments, the angle 128 is approximately equal to the angle 130.

Additionally, the set of fins 116 separate the first and second microchannel tubes 104, 106 by a distance 132. That is, each first fin 120 and each second fin 122 extends across the distance 132 to connect to the first and second microchannel tubes 104, 106. The distance 132 may enable a suitable number of microchannel tubes to be positioned along the height 112 of the header 102 while still permitting effective heat transfer between the set of fins 116 and each microchannel tube 104, 106. That is, if the distance 132 is too small, fluid may not be directed across the set of fins 116 and/or the microchannel tubes 104, 106 at a desired rate to enable a sufficient rate of heat transfer between the fluid and the set of fins 116 and/or the microchannel tubes 104, 106. However, increasing the distance 132 may reduce an available number of microchannel tubes 104, 106 that may be disposed along the height 112 of the header 102 to achieve a desirable heat rate between the refrigerant and the fluid. Thus, the distance 132 may be selected, such as at 8 millimeters, to enable a desired amount of heat transfer between the refrigerant and the fluid in the heat exchanger 100.

While the refrigerant is directed through the first and second microchannel tubes 104, 106, a fluid (e.g., the ambient air 60) may be directed across the heat exchanger 100 in a direction 134. For example, the fluid may be forced across the first and second microchannel tubes 104, 106 and across the set of fins 116, placing the fluid in thermal communication with the refrigerant. When the refrigerant flows through the ports 114, heat may be exchanged between the refrigerant and an outer surface 136 of the respective first and second microchannel tubes 104, 106 and/or the set of fins 116. For example, if the microchannel heat exchanger 100 is a condenser configured to cool the refrigerant, heat may transfer from the refrigerant to the outer surface 136 and also from the refrigerant to the set of fins 116. As the fluid is directed across the heat exchanger 100 to contact the first and second microchannel tubes 104, 106 and the set of fins 116, heat transfers from the outer surface 136 of the first and second microchannel tubes 104, 106 and from the set of fins 116 to the fluid. As such, heat is transferred from the refrigerant to the fluid to cool the refrigerant. If the microchannel heat exchanger 100 is an evaporator configured to heat the refrigerant, heat may transfer from the fluid to the outer surface 136 and to the set of fins 116. As the refrigerant is directed through the first and second microchannel tubes 104, 106, heat transfers from the outer surface 136 of the first and second microchannel tubes 104, 106 and from the set of fins 116 to the refrigerant. Thus, heat is transferred from the fluid to the refrigerant to heat the refrigerant.

A pressure of the refrigerant may decrease as the refrigerant is directed through the length 110 of the first and second microchannel tubes 104, 106. That is, the refrigerant may be pressurized to cause the refrigerant to enter the heat exchanger 100 at a desired flow rate in a direction 138 into the opening 108 of the header 102. A portion of the refrigerant may then be directed to flow through the first microchannel tube 104 in the direction 118, and another portion of the refrigerant may be directed to flow through the second microchannel tube 106 in the direction 118. When the refrigerant flows through the heat exchanger 100, the refrigerant may encounter resistance, such as from friction between the refrigerant and the inner surfaces of ports 114, which reduces the pressure of the refrigerant flowing through the heat exchanger 100. As a result, the flow rate of the refrigerant decreases as the refrigerant is directed through the length 110 of the first and second microchannel tubes 104, 106.

In some embodiments, it may be desirable to reduce the pressure drop along the length 110 of the first and second microchannel tubes 104, 106 in order to increase a flow rate at which the refrigerant flows through the heat exchanger 100. For example, a geometry of the ports 114 may be selected to enable a reduction in the pressure drop of the refrigerant. In particular, a diameter 140 of the ports 114 may be increased to reduce friction between the refrigerant and the port 114, thereby reducing the pressure drop of the refrigerant flowing through the ports 114. In additional or alternative embodiments, a shape of each port 114 within each microchannel may also be selected to achieve a desired pressure drop. Thus, although FIG. 4 illustrates each port 114 as including a generally circular cross section, it should be understood that the ports 114 may be any other suitable shape, such as a rectangular or triangular shape. It should also be appreciated that different ports 114 throughout the heat exchanger 100 may include different geometries from other ports 114 of the heat exchanger 100. For example, a first port 114 of the first microchannel tube 104 may include a first diameter and a first shape, a second port 114 of the first microchannel tube 104 may include a second diameter and a second shape, and a third port 114 of the second microchannel tube 106 may include a third diameter and a third shape.

Further, a position of the ports 114 within each microchannel tube 104, 106, such as a distance 142 between adjacent ports 114, and/or a number of ports 114 in a microchannel tube may also be selected to achieve a target performance of the heat exchanger 100. In particular, increasing the number of ports 114 in a microchannel tube 104, 106 may increase an amount of refrigerant directed through the heat exchanger 100 and thus, may increase the amount of heat exchanged between the refrigerant and the fluid. Additionally, it should be understood that each microchannel tube 104, 106 may include a different number of ports 114. Thus, although FIG. 4 depicts both the first and second microchannel tubes 104, 106 as including four ports 114, the first microchannel tube 104 may include a different number of ports 114 than the second microchannel tube 104. To accommodate for the geometry of and number of ports 114, each microchannel tube 104, 106 may include a particular length 110, tube height 144, and/or tube width 146. In some embodiments, increasing the length 110, the tube height 142, and/or the tube width 144 increases an amount of heat exchanged between the refrigerant and the fluid by increasing a surface area of contact between the refrigerant and the fluid.

In certain embodiments, the set of fins 116 may also be configured to achieve a target performance of the heat exchanger 100. For example, certain first fins 120 and/or second fins 122 may be positioned such that the set of fins 116 includes different angles 128 and/or angles 130. Additionally, although FIG. 4 illustrates the set of fins 116 as including a generally triangular profile, the set of fins 116 may include a different shape, such as a rectangular or arcuate shape. The geometry of the set of fins 116 may be selected to place the fluid passing across the heat exchanger 100 in contact with an increased surface area of the set of fins 116. In this manner, an increased amount of heat may be exchanged between the fluid and the set of fins 116 and, thus, between the fluid and the refrigerant.

It should also be understood that characteristics of the header 102 may also be selected to achieve a target performance of the heat exchanger 100. For example, the height 112 of the header 102 may be selected to accommodate a suitable number of microchannel tubes 104, 106 disposed along the height 112 of the header 102. In this manner, a target amount of refrigerant and/or fluid may be directed through and/or across the heat exchanger 100. Additionally, a position of the header 102, a shape of the opening 108, and/or a size of the opening 108 may be selected to direct the refrigerant through the header 102 and/or through the first and second microchannel tubes 104, 106 at a desired rate, pressure, velocity, temperature, and so forth. For example, the position of the header 102, the shape of the opening 108, and/or the size of the opening 108 may be selected to direct a target amount of refrigerant through the heat exchanger 100.

As described above, certain components of the heat exchanger 100 may be modified to achieve a target performance of the heat exchanger 100. It should be appreciated that in addition to adjusting an amount of refrigerant and/or fluid that may be directed through and/or across the heat exchanger 100, modifying components of the heat exchanger 100 may also adjust a cost of manufacturing the heat exchanger 100. For example, although increasing a surface area of contact between the fluid and the microchannel tubes 104, 106 increases an amount of heat exchanged between the fluid and the refrigerant, increasing the surface area of contact may also increase manufacturing costs as a result of a greater amount of material used to create the heat exchanger 100. Thus, the size of components of the heat exchanger 100 may be selected to balance performance of the heat exchanger 100 with a cost of manufacturing the heat exchanger 100.

In certain embodiments, the amount of heat exchanged between the fluid and the refrigerant is based on a distribution of a velocity of the fluid as the fluid is directed across the microchannel tubes 104, 106 of the heat exchanger 100. For example, a speed at which the fluid is directed across each microchannel tube 104, 106 may determine the amount of heat exchanged between the fluid and the refrigerant. In some embodiments, it may be desirable to have an improved distributed velocity profile of the fluid directed across the heat exchanger 100. That is, the heat exchanger 100 may be designed such that the velocity of the fluid across each microchannel tube 104, 106 along the respective lengths 110 is approximately the same (e.g., uniform) to enable the amount of heat transferred between the fluid and the refrigerant to be approximately the same across each respective length 110. In heat exchangers 100 that include a plurality of microchannel tubes 104, 106, the velocity profile of the fluid at certain portions of the heat exchanger 100 may not be desirable due to an orientation of the microchannel tubes 104, 106 and/or the set of fins 116 relative to a flow of the fluid. However, selecting a particular position of certain fins may produce an improved distributed velocity profile of the fluid across the heat exchanger 100 to improve heat transfer efficiency of the heat exchanger 100.

Figure 5:
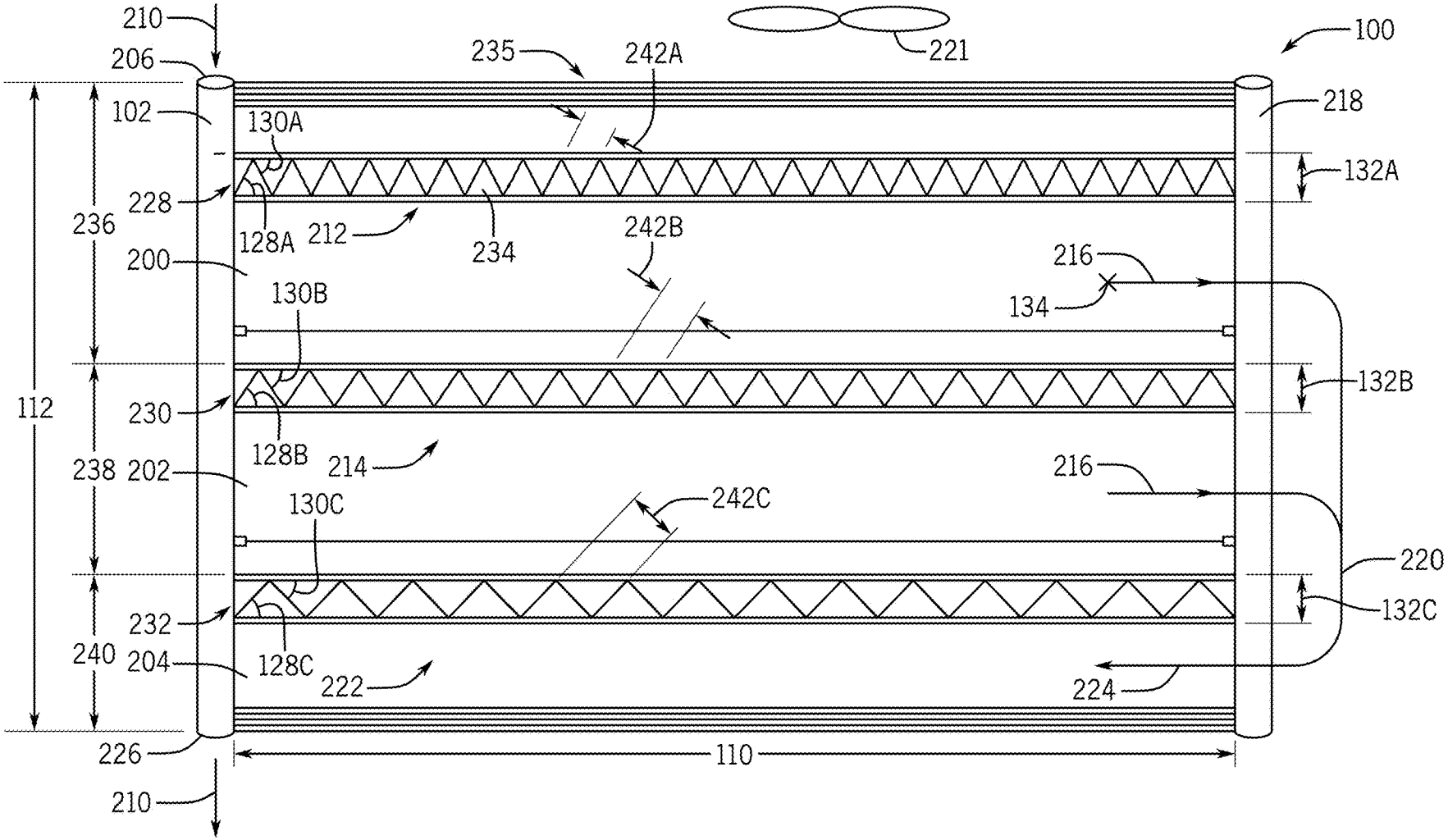
FIG. 5 is a side view of an embodiment of the microchannel heat exchanger, which may be utilized with any of the systems of FIGS. 1-3, in accordance with an aspect of the present disclosure.

FIG. 5 is a side view of an embodiment of the heat exchanger 100, which may enable and generate an improved distributed velocity profile of fluid flowing across the heat exchanger 100. For instance, the heat exchanger 100 includes a first section 200, a second section 202, and a third section 204 that may cooperatively span the height 112 of the header 102. As shown in FIG. 5, refrigerant is directed into an inlet 206 of the header 102 (e.g., a first header) of the heat exchanger 100 in a direction 210, such as via tubing fluidly coupled to the inlet 206. A portion of the refrigerant may then be directed through a first set of coils 212 (e.g., microchannel coils) of the first section 200 in a direction 216, and a remaining portion of the refrigerant may be directed through a second set of coils 214 (e.g., microchannel coils) of the second section 202 in the direction 216. In both the first section 200 and the second section 202, the refrigerant may flow through the first set of coils 212 and the second set of coils 214, respectively, along the length 110 in the direction 216 until the refrigerant reaches another header 218 (e.g., a second header) of the heat exchanger 100. In the header 218, the refrigerant from both the first and second sections 200, 202 may be combined and directed in a direction 220 to the third section 204, where the refrigerant may be directed through a third set of coils 222 (e.g., microchannel coils) in a direction 224 opposite the direction 216. After flowing through the third set of coils 222, the refrigerant may exit the heat exchanger 100 through an outlet 226 of the header 102 in the direction 210. Meanwhile, the fluid (e.g., the ambient air 60 directed by a fan 221) may be directed across the heat exchanger 100 in the direction 134 to flow across the first section 200, the second section 202, and the third section 204 and therefore across the first, second, and third sets of coils 212, 214, and 222, respectively. In this manner, the heat exchanger 100 functions as a two pass heat exchanger configured to direct the refrigerant flow through the third set of coils 222 to further exchange heat between the refrigerant and the fluid after directing the refrigerant through the first set of coils 212 and the second set of coils 214.

For clarity and discussion purposes, the first, second, and third sections 200, 202, 204 are each depicted as including two coils of the respective first, second, and third sets of coils 212, 214, and 222. It should be understood that, as described herein, each set of coils includes a plurality of microchannel tubes, where adjacent tubes in each set include a set of fins (e.g., set of fins 116) disposed therebetween. In some embodiments, the first set of coils 212 includes a first set of fins 228, the second set of coils 214 includes a second set of fins 230, and the third set of coils 222 includes a third set of fins 232. It should be appreciated that the first, second, and third sections 200, 202, 204 may each include any suitable number of coils and, thus, may include any suitable number of microchannel tubes and corresponding sets of fins.

Additionally, each set of fins 228, 230, 232 may include a fin density, or a number of fins within a certain length of the corresponding set of coils, such as the length 110. In certain embodiments, the selected fin density may impact an amount of heat exchanged between the refrigerant and the fluid (e.g., within the respective section). For example, a higher fin density increases an amount of surface area that the fluid contacts as it crosses the corresponding set of coils, and thus, may result in a greater amount of heat exchanged between the fluid and the refrigerant. Additionally, a higher fin density may decrease an amount of space 234 between the set of fins through which the fluid may flow. In some embodiments, the distance 132 between each microchannel tube of the respective sets of coils 212, 214, and 222 may still remain the same. Thus, increasing the fin density while maintaining the same distance 132 may result in an increase of the angle 128 and/or the angle 130, and decreasing the fin density while maintaining the same distance 132 may result in a decrease of the angle 128 and/or the angle 130. As such, increasing the fin density while maintaining the same distance 132 between adjacent microchannel tubes may decrease the amount of space 234, and decreasing the fin density while maintaining the same distance 132 between adjacent microchannel tubes may increase the amount of space 234.

In some cases, the velocity of the fluid increases as a size of the space 234 decreases, which may also affect the amount of heat exchanged between the refrigerant and the fluid. In some embodiments, the resulting velocity of the fluid may not be desirable across the height 112 of heat exchanger 100. Particularly, if each set of fins 228, 230, 232 of each set of coils 212, 214, and 222 includes a similar fin density, the velocity of the fluid may be concentrated near a middle portion 235 of the length 110 of the heat exchanger 100. In other words, a velocity of the fluid proximate to the header 102 and/or the header 218 may be lower than a velocity of the fluid at the middle portion 235 between the header 102 and the header 218.

In certain embodiments, it may be desirable for the fluid to have a particular velocity profile along the length 110 of the heat exchanger 100. To create the desired velocity profile and flow of fluid across the heat exchanger 100, the fin density of each respective set of coils 212, 214, and 222 may be different from one another. By adjusting the fin density of the respective sets of coils 212, 214, and 222, the flow of fluid through the different sections 200, 202, 204 of the heat exchanger 100 may be improved.

It should be appreciated that the respective fin densities of the first, second, and third sections 200, 202, 204 may be based at least in part on the respective locations of the sections 200, 202, 204 along the height 112 and/or based at least in part on the respective heights of the sections 200, 202, 204. For example, the first section 200 may be positioned above the second section 202 with respect to the height 112 and may include a first length or height 236 that is greater than a second length or height 238 of the second section 202. The second section 202 may be positioned above the third section 204 with respect to the height 112, and the second height 238 of the second section 202 may be greater than a third length or height 240 of the third section 204. As an example, the first height 236 of the first section 200 may be 50-55 centimeters (e.g., 19-22 inches), the second height 238 of the second section 202 may be 48-52 centimeters (e.g., 18-21 inches), and the third height 240 of the third section 204 may be 33-37 centimeters (e.g., 13-15 inches). In certain embodiments, the heights 236, 238, 240 of the respective sections 200, 202, 204 may be a percentage of one another. For example, the third height 240 of the third section 204 may be 65%-75% of the second height 238 of the second section 202, and the second section 202 may be 90-95% of the first height 236 of the first section 200.

In some embodiments, the fin density of the first set of coils 212 may be greater than the fin density of the second set of coils 214, and the fin density of the second set of coils 214 may be greater than the fin density of the third set of coils 222 to produce an improved velocity profile of fluid across the heat exchanger 100. For example, the fin density of the first set of coils 212 may be 8-10 fins/centimeter (e.g., 20-25 fins/inch), the fin density of the second set of coils 214 may be 7-9 fins/centimeter (e.g., 17-23 fins/inch), and the fin density of the third set of coils 222 may be 5-7 fins/centimeter (e.g., 14-18 fins/inch). The fin density of each set of coils 212, 214, 222 may also be selected as a percentage of one another. In one instance, the fin density of the third set of coils 222 may be 65-75% of the fin density of the second set of coils 214, and the fin density of the second set of coils 214 may be 85%-90% of the fin density of the first set of coils 212. Moreover, the fin density of each set of coils 212, 214, 222 may also be determined by a ratio of the respective height 236, 238, 240. That is, the ratio of the first height 236 of the first section 200 and the fin density of the first set of coils 212 may be 0.9-0.95, the ratio of the second height 238 of the second section 202 and the fin density of the second set of coils 214 may be 0.9-1, and the ratio of the third height 240 of the third section 204 and the fin density of the third set of coils 222 may be 0.85-0.9. In this manner, the fluid may be directed across the first section 200 at a higher velocity than across the second section 202, and the fluid may be directed across the second section 202 at a higher velocity than across the third section 204. In further embodiments, the fin density of each set of coils 212, 214, 222 may additionally or alternatively be based on another parameter, such as a distance between the set of coils 212, 214, 222 and/or parameters of the fan 221 that directs the fluid across the heat exchanger 100. For instance, the fin densities may be based on a flowrate of fluid directed across the respective sets of coils 212, 214, 222 via the fan 221. In the illustrated embodiment, the fan 221 is positioned proximate to the first section 200 such that the first section 200 may receive a greater flow rate of air relative to that of the sections 202, 204. As such, the first set of coils 212 may have a higher fin density that is selected based on the greater flow rate of air directed across the first set of coils 212.

In general, the fin densities of different sets of coils 212, 214, 222 of the heat exchanger 100 may be different from one another and may be determined based at least in part on the location of the set of coils 212, 214, 222 along the height 112 of the heat exchanger 100, along the length 110 of the set of coils 212, 214, 222, a desired velocity of the fluid across the set of coils 212, 214, 222, a desired distribution of velocity of the fluid across the heat exchanger 100, and/or any other property of the sets of coils and/or operation of the heat exchanger 100.

In some embodiments, in order to select or modify a fin density, a fin length 242 may be adjusted between the sections 200, 202, 204 of the heat exchanger 100. For example, the fin length 242 may be increased to increase the distance 132 between coils and expanding the space 234 between the fins. As such, the velocity of fluid across the coils having an increased fin length 242 is increased. In additional or alternative embodiments, changing the angles 128, 130 while maintaining the same distance 132 between coils, also adjusts the fin length 242. That is, the angles 128, 130 and the fin length 242 are adjusted to maintain the same distance 132 between the microchannel tubes.

In the illustrated embodiment, each set of coils 212, 214, 222 has substantially the same distance 132 between the respective coils. However, each set of coils 212, 214, 222 may include respective sets of fins having different fin lengths 242 and oriented at different angles 128, 130 such that the fin density of the first set of coils 212 is greater than the fin density of the second set of coils 214, and the fin density of the second set of coils 214 is greater than the fin density of the third set of coils 222. For instance, a first fin length 242A of each fin of the first set of fins 228 may be less than a second fin length 242B of each fin of the second set of fins 230. Additionally, the second fin length 242B of each fin of the second set of fins 230 may be less than a third fin length 242C of each fin of the third set of fins 232. Accordingly, first angles 128A, 130A between the fins of the first set of fins 228 may be greater than second angles 128B, 130B between the fins of the second set of fins 230. Furthermore, the second angles 128B, 130B between the fins of the second set of fins 228 may be greater than third angles 128C, 130C between the fins of the third set of fins 232. In additional or alternative embodiments, as described above, the distances 132 may also be different for the different sets of coils 212, 214, 222 to vary the fin densities of the sets of coils 212, 214, 222 relative to one another. For example, a first distance 132A of the first set of coils 212 may be less than a second distance 132B of the second set of coils 214, and the second distance 132B of the second set of coils 214 may be less than a third distance 132C of the third set of coils 222.

While this disclosure primarily discusses modification and selection of the fin density between sets of coils of different sections 200, 202, 204 of the heat exchanger 100, it should also be understood that the fin density may vary along the length 110 of the same set of coils 212, 214, 222. For example, a fin density of the first set of coils 212 proximate to the header 102 may be different than a fin density of the first set of coils 212 proximate to the header 218. Further, different sets of coils of the same section may include different fin densities. Further still, any combination of the aforementioned orientation or arrangement of the fins may be implemented to adjust the distribution of the velocity of the fluid flowing across the heat exchanger 100.

It should be appreciated that, although FIG. 5 illustrates the heat exchanger 100 in a particular arrangement, other configurations of the heat exchanger 100 may also be utilized. For example, the heat exchanger 100 may include additional sections and/or additional headers to direct the refrigerant through additional sets of coils before exiting the heat exchanger 100. Moreover, the heat exchanger 100 may be configured to change directions of the flow of refrigerant through any of the sets of coils and/or direct the refrigerant in different directions than depicted in FIG. 5. Additionally or alternatively, the heat exchanger 100 may be modified to include a different shape than depicted in FIG. 5.

Figure 6:
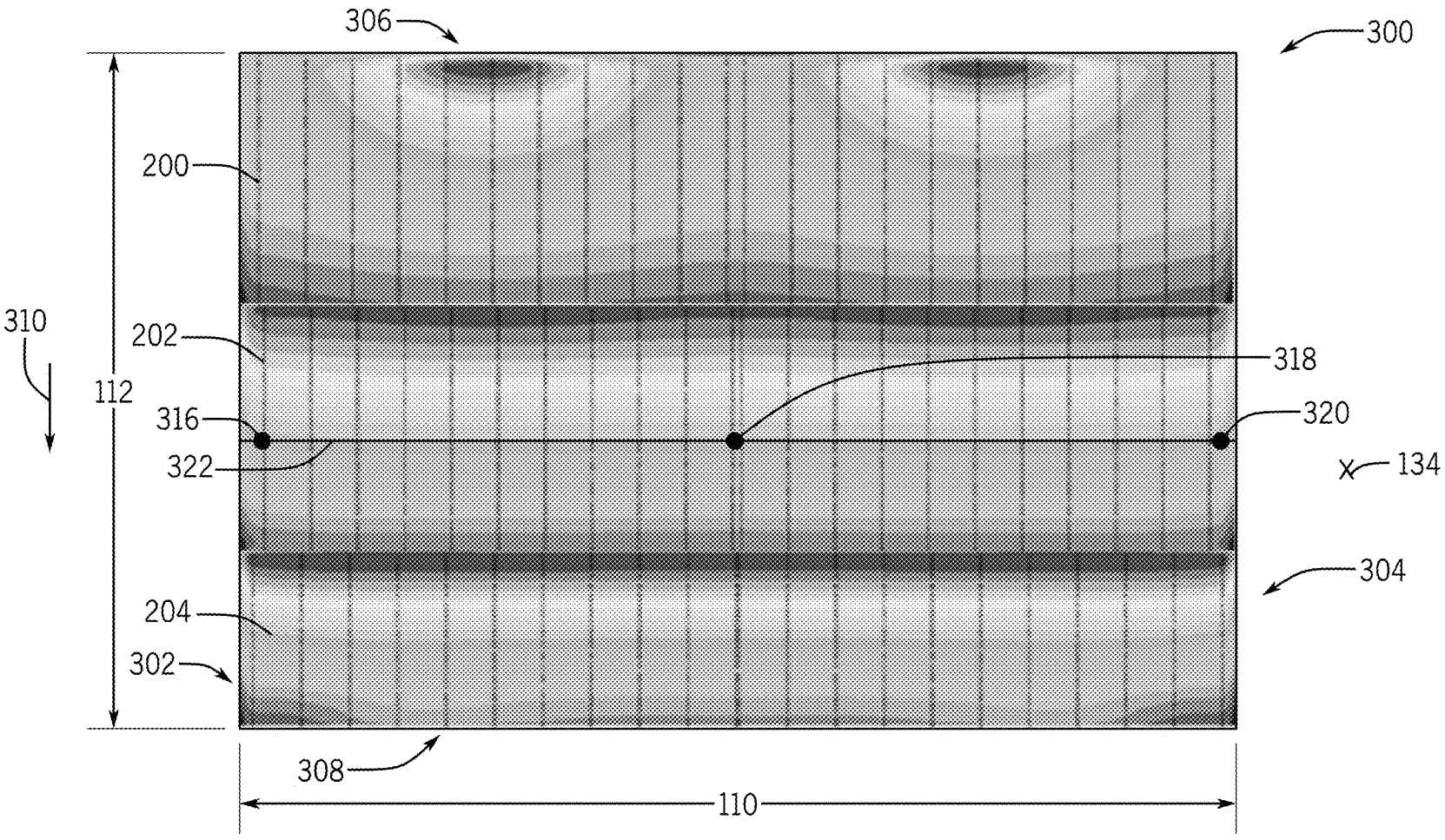
FIG. 6 is a graphical illustration of a velocity profile of a fluid flowing across an embodiment of the microchannel heat exchanger of FIGS. 4 and 5, in accordance with an aspect of the present disclosure.

FIG. 6 is a graphical illustration of an embodiment of a velocity profile 300 of fluid flowing across the heat exchanger 100 of FIG. 5 in the direction 134. In general, the velocity profile 300 includes a first edge 302 indicative of an area of the heat exchanger 100 proximate to the header 102, a second edge 304 indicative of an area of the heat exchanger 100 proximate to the header 218, a third edge 306 indicative of an area of the heat exchanger 100 at a top portion of the height 112, and a fourth end 308 indicative of an area of the heat exchanger 100 at a bottom portion of the height 112. In certain implementations of the heat exchanger 100, a fan is positioned adjacent to the heat exchanger 100. The fan is configured to draw or force fluid across the heat exchanger 100 to place the fluid in thermal communication with the sets of coils 212, 214, 222. Due to the position of the fan, a generally greater amount of fluid may be drawn or forced across the first section 200 compared to the second section 202 and a generally greater amount of fluid may be drawn or forced across the second section 202 compared to the third section 204. Thus, as illustrated in FIG. 6, the respective velocities of the fluid across the first, second, and third sections 200, 202, 204 are different from one another, and the velocity of the fluid along the height 112 of the header 102 within each of the respective first, second, and third sections 200, 202, 204 vanes. Specifically, in a direction 310 along the height 112 of the header 102, the velocity of the fluid generally decreases. As such, the velocity of the fluid across the first section 200 may generally be greater than the velocity of the fluid across the second section 202, and the velocity of the fluid across the second section 202 may generally be greater than the velocity of the fluid across the third section 204.

Additionally, along the length 110, the velocity of the fluid is generally the same throughout each respective section. In other words, the velocity profile 300 may include a first point 316, a second point 318, and a third point 320 disposed along a line 322 generally parallel to the length 110 and at a constant axial location along the height 112 of the heat exchanger 100. The velocity of the fluid at the first point 316, the velocity of the fluid at the second point 318, and the velocity of the fluid at the third point 320 may be substantially similar to one another. For example, the velocity of the fluid at the first point 316, the second point 318, and the third point 320 may vary by less than 10%, less than 5%, and/or less than 1%. In this manner, the velocity of the fluid at a common axial location along the height 112 may be substantially the same across the length 110 of each set of coils. As such, the heat exchanged between the fluid and the refrigerant along the length 110 of each respective set of coils may be similar. As a result, an overall amount of heat exchanged between the fluid and the refrigerant in the heat exchanger 100 with varying fin densities that produce the velocity profile 300 may be greater than an amount of heat exchanged between a fluid and a refrigerant in a heat exchanger having uniform fin densities, where the velocity of the flow of fluid may not be desirably distributed along the height 112.

As set forth above, the present disclosure is directed to a heat exchanger of an HVAC&R system. Specifically, a heat exchanger of an HVAC&R system may be a microchannel heat exchanger configured to direct refrigerant through multiple microchannel tubes, where each adjacent microchannel tube include a set of fins disposed therebetween. A fluid may be directed across the microchannel tubes and the set of fins to exchange heat with the refrigerant flowing through the microchannel tubes. A velocity of the fluid across the heat exchanger may be based on an orientation of the fins, such as a density of the fins or, in other words, a number of fins within a specific length of the microchannel tube. As a result, selecting the density of fins for different sections or coils of the heat exchanger in this manner may cause the velocity of the fluid across the heat exchanger at different sections of the heat exchanger to produce an improved distributed velocity profile of the fluid across the heat exchanger. For example, the density of fins at a section proximate to where the refrigerant enters the heat exchanger may be different than the density of fins at a section proximate to where the refrigerant exits the heat exchanger. In another example, the density of fins at a section proximate to where a fan is positioned relative to the heat exchanger may be different than the density of fins at a section farther from where the fan is positioned. As a result of the varying densities of the fins, the velocity of the fluid along the length of each microchannel tube and set of fins may be approximately the same or more uniform. In this manner, a velocity of the fluid across a heat exchanger having varying fin densities may enhance an efficiency of the heat exchanger as compared to a heat exchanger that includes the same fin density throughout the heat exchanger. Accordingly, the overall amount of heat exchanged between the fluid and the refrigerant may be increased.

While only certain features and embodiments of the disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out the disclosure, or those unrelated to enabling the claimed disclosure). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, air conditioning, and refrigeration (HVAC&R) system, comprising:

a plurality of heat exchangers, wherein each heat exchanger of the plurality of heat exchangers comprises:

a plurality of microchannel tubes, wherein each microchannel tube of the plurality of microchannel tubes is configured to direct refrigerant therethrough;

a plurality of fin sets, wherein each fin set of the plurality of fin sets is disposed between corresponding adjacent microchannel tubes of the plurality of microchannel tubes, and wherein each fin set of the plurality of fin sets comprises a respective fin density that is based on a location of the respective fin set along a height of the heat exchanger;

an inlet at a first end of the height of the heat-exchanger;

an outlet at a second end of the height of the heat exchanger, opposite the first end;

a first section spanning a first distance of the height, wherein the first section comprises a first fin set of the plurality of fin sets that includes a first fin density;

a second section spanning a second distance of the height, wherein the second section comprises a second fin set of the plurality of fin sets that includes a second fin density; and a third section spanning a third distance of the height, wherein the third section comprises a third fin set of the plurality of fin sets that includes a third fin density; and a fan disposed adjacent the respective first end of the respective height of each heat exchanger of the plurality of heat exchangers, wherein the fan is configured to force a fluid across the plurality of heat exchangers, wherein, in each heat exchanger of the plurality of heat exchangers, the first fin set is disposed proximate to the inlet, the third fin set is disposed proximate to the outlet, the first fin density is greater than the second fin density, and the second fin density is greater than the third fin density, and wherein the plurality of heat exchangers comprises a first heat exchanger and a second heat exchanger arranged in a V-shape configuration.

2. The HVAC&R system of claim 1, wherein each heat exchanger of the plurality of heat exchangers comprises a first header and a second header, wherein the first header comprises the inlet and the outlet, wherein each heat exchanger of the plurality of heat exchangers is configured to direct the refrigerant from the first header and through a first microchannel tube of the plurality of microchannel tubes, from the first microchannel tube of the plurality of microchannel tubes through a second microchannel tube of the plurality of microchannel tubes, and from the second microchannel tube of the plurality of microchannel tubes towards the outlet.

3. The HVAC&R system of claim 2, wherein the first header is configured to direct the refrigerant from the inlet toward the first microchannel tube, the first microchannel tube is configured to direct the refrigerant to the second header, the second header is configured to direct the refrigerant toward the second microchannel tube, and the second microchannel tube is configured to direct the refrigerant toward the outlet of the first header.

4. The HVAC&R system of claim 3, wherein each microchannel tube of the plurality of microchannel tubes comprises a plurality of ports configured to direct the refrigerant from the first header to the second header or from the second header to the first header.

5. The HVAC&R system of claim 1, wherein each fin set of the plurality of fin sets forms a zigzag pattern between corresponding adjacent microchannel tubes of the plurality of microchannel tubes.

6. A heating, ventilation, air conditioning, and refrigeration (HVAC&R) system, comprising:

a plurality of heat exchangers, wherein each heat exchanger of the plurality of heat exchangers comprises:

a plurality of microchannel coils arranged along a height of the heat exchanger, wherein each microchannel coil of the plurality of microchannel coils extends along a length of the heat exchanger;

a plurality of fin sets, wherein each fin set of the plurality of fin sets is disposed between a corresponding pair of adjacent microchannel coils of the plurality of microchannel coils, wherein each fin set of the plurality of fin sets extends along the length of the heat exchanger, and wherein each fin set of the plurality of fin sets comprises a fin density that is based at least in part on a respective location of the fin set along the height of the heat exchanger;

an inlet disposed at a first end of the height of the heat exchanger;

an outlet disposed at a second end, opposite the first end, of the height of the heat exchanger;

a first section spanning a first distance of the height, wherein the first section comprises a first subset of fin sets of the plurality of fin sets that includes a first fin density;

a second section spanning a second distance of the height, wherein the second section comprises a second subset of fin sets of the plurality of fin sets that includes a second fin density; and a third section spanning a third distance of the height, wherein the third section comprises a third subset of fin sets of the plurality of fin sets that includes a third fin density; and a fan positioned adjacent the respective first end of the respective height of each the heat exchanger of the plurality of heat exchangers, wherein the fan is configured to force a fluid across the plurality of heat exchangers, wherein, in each heat exchanger of the plurality of heat exchangers, the first subset of fin sets is disposed proximate to the first end of the height of the heat exchanger, the second subset of fin sets is disposed proximate to the second end of the height of the heat exchanger, the first fin density is greater than the third fin density, and the third fin density is greater than the second fin density, and wherein the plurality of heat exchangers comprises a first heat exchanger and a second heat exchanger, and the first heat exchanger and the second heat exchanger are arranged to form a V-shape configuration.

7. The HVAC&R system of claim 6, wherein the first distance is greater than the third distance, and wherein the third distance is greater than the second distance.

8. The HVAC&R system of claim 6, wherein a respective distance between adjacent microchannel coils of the plurality of microchannel coils is approximately equal.

9. The HVAC&R system of claim 6, wherein each heat exchanger of the plurality of heat exchangers is a two pass heat exchanger, each heat exchanger of the plurality of heat exchangers is configured to direct a refrigerant through a first microchannel coil of the plurality of microchannel coils, and each heat exchanger of the plurality of heat exchangers is configured to direct the refrigerant through a second microchannel coil of the plurality of microchannel coils after directing the refrigerant through the first microchannel coil.

10. A heating, ventilation, air conditioning, and refrigeration (HVAC&R) system, comprising:

a plurality of heat exchangers, wherein each heat exchanger of the plurality of heat exchangers comprises:

a first section disposed along a height of the heat exchanger, wherein the first section comprises a plurality of first microchannel tubes and a plurality of first fin sets disposed between corresponding adjacent first microchannel tubes of the plurality of first microchannel tubes, wherein each first fin set of the plurality of first fin sets comprises a first number of fins;

a second section disposed along the height, wherein the second section comprises a plurality of second microchannel tubes and a plurality of second fin sets disposed between corresponding adjacent second microchannel tubes of the plurality of second microchannel tubes, wherein each second fin set of the plurality of second fin sets comprises a second number of fins, and wherein the second number of fins is less than the first number of fins;

a third section disposed along the height, wherein the third section comprises a plurality of third microchannel tubes and a plurality of third fin sets disposed between corresponding adjacent third microchannel tubes of the plurality of third microchannel tubes, wherein each third fin set of the plurality of third fin sets comprises a third number of fins, and wherein the third number of fins is less than the second number of fins;

a first header and a second header, wherein each first microchannel tube of the plurality of first microchannel tubes extends from the first header to the second header, each second microchannel tube of the plurality of second microchannel tubes extends from the first header to the second header, and each third microchannel tube of the plurality of third microchannel tubes extends from the first header to the second header;

an inlet disposed at a first end of the height; and an outlet disposed at a second end of the height, opposite the first end, wherein the first section is disposed proximate to the first end, and the third section is disposed proximate to the second end; and a fan disposed adjacent the respective first end of each heat exchanger of the plurality of heat exchangers, wherein the fan is configured to force a fluid across the plurality of heat exchangers, wherein, in each heat exchanger of the plurality of heat exchangers, the first header is configured to direct a first portion of a refrigerant from the first header to the plurality of first microchannel tubes and to direct a second portion of the refrigerant, different from the first portion of the refrigerant, from the first header to the plurality of second microchannel tubes, and wherein the second header is configured to receive the first portion of the refrigerant from the plurality of first microchannel tubes, receive the second portion of the refrigerant from the plurality of second microchannel tubes, and direct the first portion of the refrigerant and the second portion of the refrigerant to the plurality of third microchannel tubes, and wherein the plurality of heat exchangers comprises a first heat exchanger and a second heat exchanger arranged in a V-shape configuration.

11. The HVAC&R system of claim 10, wherein each first fin set of the plurality of first fin sets forms a first angle with a respective first microchannel tube of the plurality of first microchannel tubes, wherein each second fin set of the plurality of second fin sets forms a second angle with a respective second microchannel tube of the plurality of second microchannel tubes, wherein the first angle is greater than the second angle.

12. The HVAC&R system of claim 10, wherein the first section is disposed above the second section along the height of the heat exchanger.

13. The HVAC&R system of claim 6, wherein a value of the respective fin density of each fin set of the plurality of fin sets is determined based at least in part on a desired flowrate of the fluid directed across the fin set via the fan.

14. The HVAC&R system of claim 6, wherein, in each heat exchanger of the plurality of heat exchangers, a value of the respective fin density of each fin set of the plurality of fin sets is determined based at least in part on a desired velocity distribution of the fluid directed by the fan across the heat exchanger.

15. The HVAC&R system of claim 1, wherein the second section is disposed between the first section and the third section along the height of the heat exchanger.

16. The HVAC&R system of claim 1, wherein, in each heat exchanger of the plurality of heat exchangers, the first section comprises a first set of microchannel tubes of the plurality of microchannel tubes, the second section comprises a second set of microchannel tubes of the plurality of microchannel tubes, the third section comprises a third set of microchannel tubes of the plurality of microchannel tubes, and the heat exchanger comprises:

a first header comprising the inlet and the outlet; and a second header, wherein each microchannel tube of the plurality of microchannel tubes extends from the first header to the second header.

17. The HVAC&R system of claim 16, wherein the first header is configured to direct a first portion of the refrigerant from the first header to the first set of microchannel tubes, the first header is configured to direct a second portion of the refrigerant, different from the first portion of the refrigerant, from the first header to the second set of microchannel tubes, the second header is configured to receive the first portion of the refrigerant from the first set of microchannel tubes, the second header is configured to receive the second portion of the refrigerant from the second set of microchannel tubes, and the second header is configured to direct the first portion of the refrigerant and the second portion of the refrigerant to the third set of microchannel tubes.

18. The HVAC&R system of claim 1, wherein, in each heat exchanger of the plurality of heat exchangers, the first distance of the height is greater than the second distance of the height, and the first distance of the height is greater than the third distance of the height.

19. The HVAC&R system of claim 18, wherein the first fin density is based at least in part on the first distance of the height, the second fin density is based at least on the second distance of the height, and the third fin density is based at least on the third distance of the height.

20. The HVAC&R system of claim 19, wherein a first ratio of the first distance of the height and the first fin density is 0.9-0.95, a second ratio of the second distance of the height and the second fin density is 0.9-1, and a third ratio of the third distance of the height and the third fin density is 0.85-0.9.

* * * * *